United States Patent [19]

Post

[11] Patent Number: 4,579,768

[45] Date of Patent: Apr. 1, 1986

[54] BRASS PLAQUES

[75] Inventor: Hans G. Post, Don Mills, Canada

[73] Assignee: The Diecut Group, Weston, Canada

[21] Appl. No.: 515,992

[22] Filed: Jul. 22, 1983

[51] Int. Cl.[4] ..... B44C 5/04

[52] U.S. Cl. ..... 428/187; 29/469.5; 40/615; 156/252; 428/596; 428/913.3

[58] Field of Search ..... 29/469.5; 40/593, 594, 40/595, 615; 156/252; 428/542.2, 913.3, 596, 674, 187, 597, 542.6

[56] References Cited

U.S. PATENT DOCUMENTS

| | | | |
|---|---|---|---|
| 292,090 | 1/1884 | Ayres | 40/542 X |
| 1,193,963 | 8/1916 | Allen | 40/615 X |
| 1,665,374 | 4/1928 | Lavarack et al. | 40/615 |
| 2,004,635 | 6/1935 | Price | 40/615 |
| 2,411,187 | 11/1946 | Boogher | 428/187 X |
| 3,692,610 | 9/1972 | Kornstein | 428/187 X |
| 4,275,116 | 6/1981 | Kratschmer | 428/354 X |

FOREIGN PATENT DOCUMENTS

| | | | |
|---|---|---|---|
| 6216 | of 1887 | United Kingdom | 428/596 |

OTHER PUBLICATIONS

Know How Making Stencils, by Usborne, Comic Section, The Washington Post, Oct. 5, 1975.

*Primary Examiner*—Henry F. Epstein

[57] ABSTRACT

Brass plaque indicia indicating products are provided according to the present invention which can be economically produced by stamping of brass plate. Prior to the present invention stamping of brass plate to define brass indicia was not economical relative to forging techniques due to the high amount of scrap brass plate which resulted by the stamping operation. The present invention recognizes that the scrap produced during this stamping of the indicia can provide a brass plaque having an interior which defines an outline of the indicia and if a background member is secured behind the brass plate this combination defines the desired indicia. Therefore by stamping of brass indicia and using the remaining scrap to define a further brass plaque which in combination with a background member defines the indicia, the stamping operation becomes very economical relative to a forging operation as two brass products for identifying indicia are produced by the one stamping operation. Furthermore, it has been found by providing a polished brass surface and a background member of contrasting color, the visibility of the indicium is greatly increased with decreasing lighting conditions relative to the recognition of the brass indicium itself. This increased visibility is due to the light reflective nature of the brass plaques and the contrasting color of the background member which advantageously diffuses light to further enhance the contrast.

14 Claims, 11 Drawing Figures

BRASS PLAQUES

FIELD OF THE INVENTION

The present invention relates to plaques for mounting on homes and other buildings to identify at least in part the address of the buildings. In particular the invention is appropriate for the making of brass numbers and letters for identifying such buildings.

BACKGROUND OF THE INVENTION

In recent years, the popularity of brass household accessories such as brass wall plates, brass kickboards, brass lighting fixtures, brass mailboxes and brass letters and numbers has greatly increased. Most of these products are made from brass plate which can be stamped and cut easily. Producing these products from brass plate is quite economical and problems with respect to porousity of the metal and surface of the metal are more easily controlled with respect to brass plate as opposed to brass castings. However, with respect to indicia and in particular numbers and letters these can be manufactured more economically by foundaries, primarily due to the large amount of waste or scrap material that results if these same indicia were stamped from plate. Problems with respect to colour and porousity remain, however, the cost advantage of manufacturing by casting remained critical and therefore these products continue to be produced by casting techniques.

Brass numbers or letters used to at least partially identify the address of a building or individual home, also serve a decorative purpose and therefore the brass finishes have proven popular. In particular, polished brass surfaces are now commonly used even though these numbers or letters are not easily recognizable as dusk approaches unless additional lighting is provided in close proximity to the indicia. Therefore it would be desirable to produce a brass type indicia which would provide the rich decorative effect sought by the purchasers of the product, while providing a product where the indicia was more readily recognizable with poor lighting conditions.

SUMMARY OF THE PRESENT INVENTION

The present invention provides a product and a process for producing brass indicia such as numbers and letters from brass plate while overcoming the previous cost disadvantage which forced most brass numbers to be produced by casting or forging. By properly stamping a desired indicia from a brass plate, one is left with at least one piece of what was formerly scrap plate which defines an outline in the interior of the piece of the indicium which was just stamped. This brass plate with the outline can advantageously be combined with a background member whereby the indicium is of a colour of the background member and the brass plate provides a rich decorative framing member about the indicium. It is also been found by providing a highly reflective polished brass surface ie. the brass plate defining the outline of the indicium and providing a background member of contrasting colour relative to the finish of the brass plate, that it is much easier to identify the indicium as the identification thereof is essentially independent of the surface to which it is to be mounted. This is in contrast to cast brass indicium or stamped brass indicium where the indicia is directly mounted on a surface and the surface to which it is to be secured determines how readily the indicium can be recognized.

Therefore, with this invention the scrap, which prior to the invention rendered a stamping operation of brass indicia non competitive with forging techniques, is advantageously used to provide a highly decorative plaque which when combined with the background member of contrasting colour, and particularly when used with a background member of a black colour with a light diffusing surface, provides a product where the particular indicium is more easily recognized with reduced lighting. Therefore, in contrast to forging and other stamping techniques, this process results in two marketable products and hence the production costs are cut approximately half.

The stamping process according to the present invention for producing brass products, identifying indicium for securement to the exterior of a building from a single brass plate comprises cutting the brass plate to an appropriate size blanking out the indica from the brass plate interior to the periphery thereof to produce both a brass indicium and a brass plate indicium outlining portion, securing a background plate member of contrasting colour to the rear face of said brass plate indicium outlining portion in a manner to provide securement of said outline portion to the background member and wherein the indicium is a colour of the background member whereby two separate products are provided from the brass plate for indicating the indicium.

Furthermore, the product and process of the present invention results in brass indicium and brass indicium identifying plaques which are more consistent in colour and porousity as they are made from plate as opposed to individual castings which are known to change in colour due to varying alloy content and will vary in porousity due to the casting operation.

BRIEF DESCRIPTION OF THE DRAWINGS

The preferred embodiments of the invention are shown in the drawings wherein.

DETAILED DESCRIPTION ACCORDING TO THE PREFERRED EMBODIMENTS

Reference in the specification is made to stamping operations, however this is intended to include what some people refer to as blanking operations. Both terms are generally interchangeably used in trade and the present specification does not distinguish therebetween.

Figure 1:
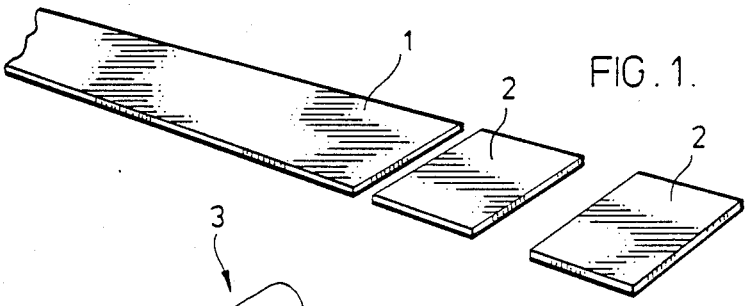
FIG. 1 is a partial perspective view showing the stamping of brass plate into smaller rectangular sections.
Figure 2:
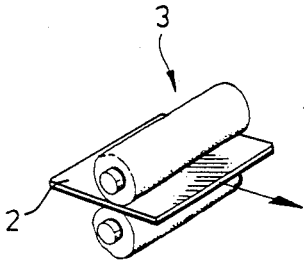
FIG. 2 diagrammatically illustrates a buffing operation of the individual cut sections.
Figure 3:
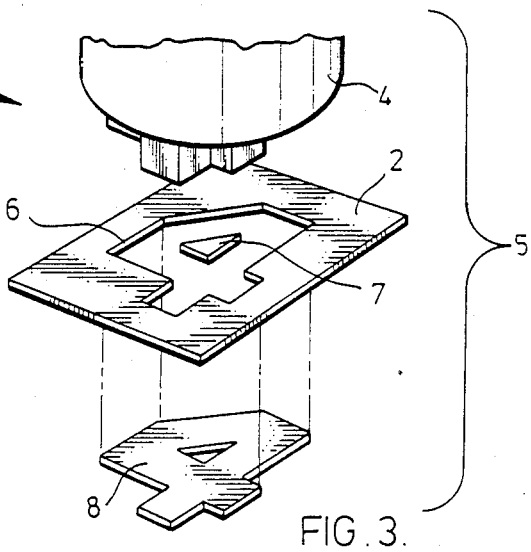
FIG. 3 schematically illustrates the blanking operation for producing the particular indicia.

A length of brass alloy plate 1, preferably brass alloy 730, shown in FIG. 1 has been partially cut to define the two individual rectangular sections generally shown as 2. These individual sections then undergo a number of operations for forming of two indicia indicating members whereby it is possible to economically produce brass indicia and brass indicia plaques by stamping a brass alloy plate or brass plated plate. In FIG. 2 the individual sections 2 are passed through buffing rollers generally shown at 3 for providing a highly polished surface to these rectangular sections. Following the buffing operation, the rectangular sections are then blanked as generally shown in FIG. 3 to provide the individual section generally shown as 2 having the border 6 and the interior triangular piece 7 for defining a border of the indicium. The blanking operation completed by the punch 4 also results in the brass indicia 8 whereby this indicia 8 is similar to the brass numbers and letters now being sold however it is made from brass plate as opposed to being produced by a casting operation. The blanking operation is schematically illustrated at 5. It can be appreciated the blanking and buffing operations could be completed prior to cutting the plate into the individual sections.

The products of the blanking operation, namely the indicia 8 and the brass plate 2 having the outlining defining border have been bent to a certain extent by the blanking operation and are schematically shown being passed through straightening rollers 12 at position 10. Also schematically illustrated in FIG. 4 is the straightened brass section 2*a* and the straightened interior triangle 7*a*.

Figure 4:
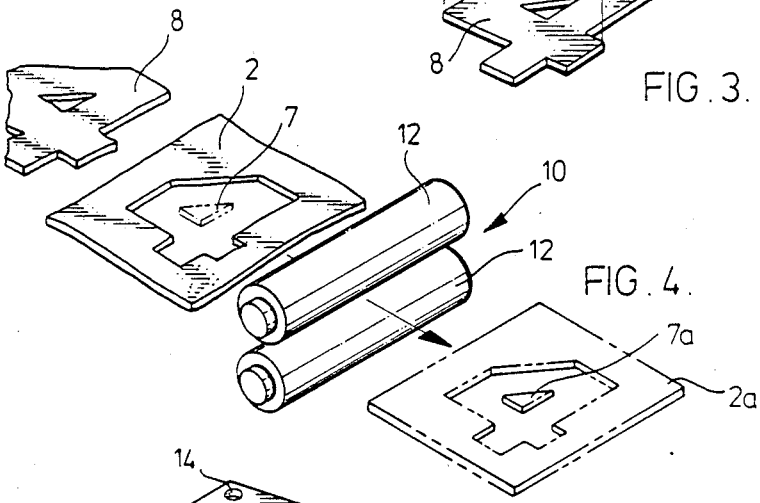
FIG. 4 is a schematic representation of the straightening operation.
Figure 5:
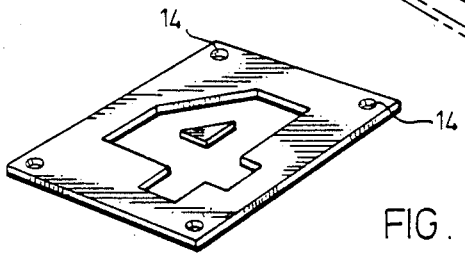
FIG. 5 shows the straightened rectangular section having within the perimeter thereof, the outline for defining the indicium.
Figure 6:
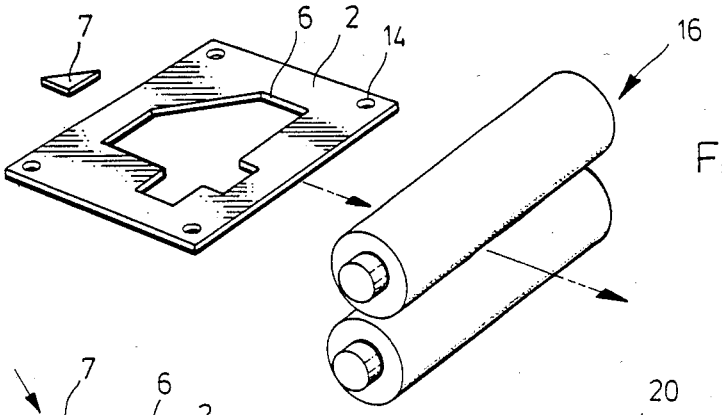
FIG. 6 schematically illustrates a final buffing operation to remove surface defects caused by the blanking operation.
Figure 7:
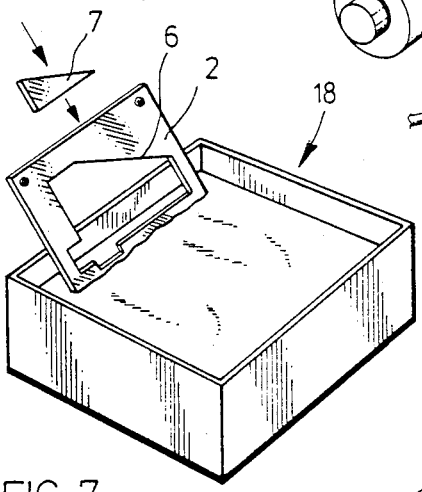
FIG. 7 schematically illustrates the degreasing operation.
Figure 8:
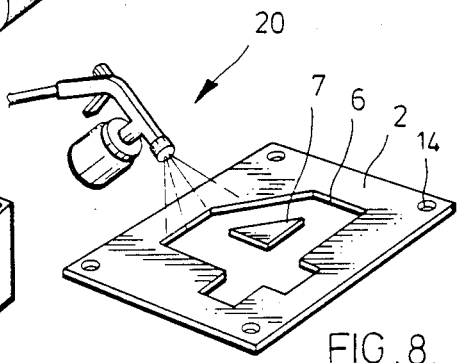
FIG. 8 schematically illustrates the lacquering of the brass plate components.
Figure 9:
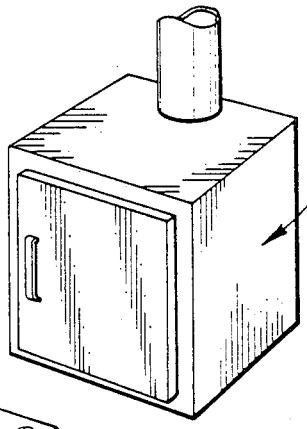
FIG. 9 schematically illustrates the baking of the finish.

In FIG. 4 the straightened section having the indicium outlining border has been provided with apertures 14 counter sunk in the brass section to allow securement to a building or other structure to which it is to be secured. After the final machining operations have been completed the products are then passed through a final buffing operation as generally shown in FIG. 6 at position 16 to remove any surface defects caused by the blanking operation and by the drilling of the apertures. Once this has been completed the products are passed through a degreasing bath 18 in preparation for the lacquer finishing surface used to protect the brass plate. It should be noted in FIG. 6 and 7 that only the brass plaques are shown undergoing the various operations however in fact the brass indicium generally shown as 8 in FIG. 3 would undergo the same operations. After the lacquer finish has been applied to the products as schematically shown by the application of the lacquer by gun 20 in FIG. 8, the products are placed in an oven 22 to dry the finish.

Figure 10:
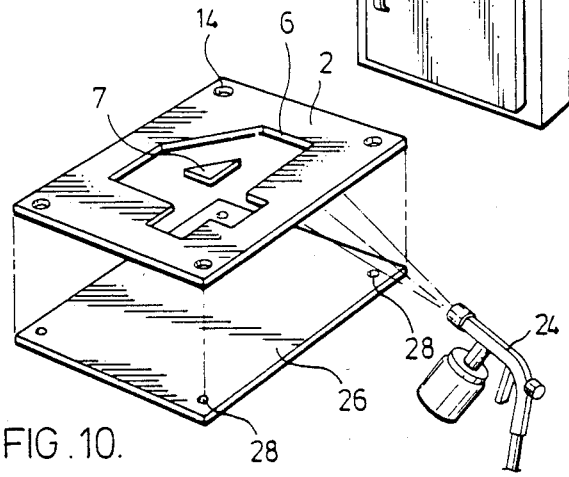
FIG. 10 schematically illustrates the assembly of the brass plaque.

In FIG. 10 the rectangular section 2 with the outlining border 6 and the triangular piece 7 are secured to a background plate member 26 of a colour contrasting with the buffed brass plate and preferrably of a black mat finish suitable for outside securement. Such a finish could be a black enamel, black acrylic finish or other suitable exterior finishes. It is also possible that the background plate member 26 have a fluorescent surface whereby at night the indicium defined by the exposed exterior background within the periphery of the rectangular section 2 will be more easily visible. However, in practice the use of a black finish in combination with the highly reflective polished brass surface of the rectangular section 2 provides increased visibility as light is reflected off the brass plate and the indicia identified by the exposed surface of the background plate member is more easily recognizable from a distance. Although not shown in FIG. 10 the actual assembly of the background plate member 26 and the section 2 can be completed in a jig to assure proper location of the individual pieces and the triangular piece 7. Some letters and members will have interior island portions such as 7 which require proper location within the outlining border 6. Thus the background plate member which could be metal, plastic or other material, serves to additionally secure what was formerly considered scrap material in a manner to identify the particular indicium. Furthermore it is preferable that the section 2 and piece 7 be directly secured to the background member and gluing with a silicone sealant has proven quite satisfactory and can be applied as shown by spray gun 24. Again it can be appreciated that other methods of securing the brass section and the background plate member are possible, for example riveting, welding, other types of gluing operations, or securing by screws during mounting of the plaque.

Figure 11:
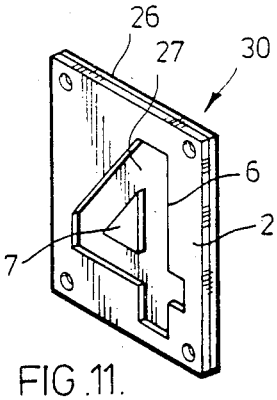
FIG. 11 shows the assembled brass plaque.

The brass plaque as shown in FIG. 11 generally as 30 has the indicium indicated by the exposed area 27 of the background plate member 26 within the outline 6 and exterior to the triangular sections 7. One can also appreciate that the background plate member is rearwardly of the brass section 2 by the thickness of this section and this arrangement provides a very strong image of the indicia. Furthermore as can be appreciate at about dusk, the lighting conditions are quite poor however the highly polished brass section 2 reflects the light and the black background tends to diffuse the light providing a contrast with the brass plate allowing the indicium to be easily identified. Thus the brass plaque for identifying the indicium as shown in FIG. 11 is more easily recognized under poor lighting conditions than the brass indicia 8 as shown in FIG. 3. Furthermore it can be appreciate that regardless of the surface to which the final product 30 is mounted, this contrast is preset and therefore the ease of recognition of the indicia is essentially predetermined and is not wholly dependent upon the background to which it is to be secured as would be the case with the brass indicia 8.

The process as disclosed hs produced two brass alloy products for defining indicia essentially from one brass section. Thus the section 2 shown in FIG. 1 which is the most expensive material cost in producing brass indicia from brass plates is almost fully utilized and results in two products when combined with the background plate member as discussed above. Therefore the stamping operation can compete quite favourably with casting of brass indicia which has previously been the practice. Stamping operations were not considered economical for producing brass indicia due to the waste materials which would normally be considered the section 2 and the triangular section 7 indicated in FIG. 3.

With respect to FIG. 10 and the assembly of the rectangular section 2 to the background plate member 26 it can be seen that the background plate member has been provided with oversized holes 28 to align with apertures 14 in the brass plate. In this way exact registration of the two components is not required.

According to the present stamping process it is possible to obtain two brass indicia indicating members from a section of brass plate thereby making this process an economic alternative to the casting operation while producing a product which the characteristics thereof are more easily controlled. In casting operations porousity and colour are difficult to maintain and vary from product to product. This provides some problems with matching of various members as the colour can vary considerably. However by producing products from brass plate this is not a problem and the amount of scrap is greatly reduced. The actual size of the individual sections 2 is preferrably slightly larger than that required in order to respectively blank out the indicia to provide a fairly generous border about the outline of the indicia which eventually be used to form a plaque. By combining some of these individual sections in an abutting relationship a very rich brass extension is provided which is highly decorative and provides a very pleasing appearance and is a different alternative to merely having brass indicia.

Although the process in the individual products shown have been described with respect to the method of making the number 4 it can be appreciated that the indicia could be numeric or alphabetic, either of which can easily be produced by the present process. In both of these cases there will be some indicia which will require centering of an interior island portion such as the section 7 however this can easily be accomplished by the use of jigs if necessary.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or priviledge is claimed are defined as follows:

1. A stamping process for producing brass products identifying indicium for securement to the exterior of buildings said products being made from brass plate having a polished surface which reflects a high portion of incident light comprising:

cutting the brass plate to an appropriate size, blanking out the indicium from the brass plate interior to the periphery thereof to produce both a brass indicium and a brass plate indicium outlining portion, securing a background plate of metal or plastic having a light diffusing surface to the rear face of said brass plate indicium outlining portion in a manner to expose said light diffusing surface within said outlining portion, the outline of said indicium being easily recognizable due to the contrast between said light diffusing surface and said brass plate, said method producing a first product defined by the blanked indicium and a second product defined by said brass plate indicium outlining portion and said background plate.

2. A stamping process as claimed in claim 1 including polishing the brass plate prior to blanking out the indicium and including straightening both said indicium and said plate indicium outlining portion after blanking out the indicium.

3. A stamping process as claimed in claim 2 including securing said background plate and said outlining portion by gluing thereof.

4. A process for producing two brass plates for use in identifying an alphabetic or numeric indicium from a single brass plate with minimal scrap material, said brass plate having a light reflective surface said process comprising:

stamping the desired indicium from the interior of such brass plate in a manner such that said indicium was generally centered in such plate to produce a brass indicium and a brass plate defining an outline of such indicium within the periphery of said plate, and securing a background plate of metal or plastic having a light diffusing surface relative to the light reflective surface of said brass plate to said outline defining plate and thereby form an indicium of the light diffusing surface exposed within and framed by the light reflective surface of the brass plate outlining member.

5. A process as claimed in claim 4 including securing portions of the brass plate interior to the outline of the indicium to said background in such a manner to define the indicium.

6. A plaque for securement to an exterior wall of a building or other structure and define within the plaque an alphabetic or numeric indicium, comprising a metal plate means having a front face of brass plate or brass alloy plate and a rear face, a portion of said metal plate means being removed to define within the periphery of the plate means a brass outline of said indicium, and a background plate of metal or plastic secured to the rear face of said metal plate means and exposed through said metal plate means within the outline of said indicium, said front face having a light reflective surface and said background plate exposed through said metal plate means having a light diffusing surface, said light reflective surface and said light diffusing surface being of contrasting colours emphasizing the outline of the indicium which is further enhanced due to the dissimilar light reflective characteristics of said metal plate means and said background plate.

7. A plaque as claimed in claim 6 wherein said metal plate means is a brass plate having the front face thereof polished and said background plate is generally the same exterior shape and size of said brass plate with the portion of said background plate exposed through said brass plate being of a black colour.

8. A plaque as claimed in claim 7, wherein said brass plate and said background plate are generally rectangular.

9. A plaque as claimed in claim 7, wherein the portion of said background plate exposed through said brass plate has a mat finish.

10. A plaque as claimed in claim 7, wherein said brass plate and said background plate are secured by a silicone adhesive.

11. A plaque for securement to an exterior wall of a building or other structure and define within the plaque a single alphabetic or numeric indicium comprising a metal plate means of brass alloy plate or brass plated plate having a light reflective front face of polished brass, an interior portion of said plate means being removed to define within the periphery of the plate means an outline of said indicium, and a background plate member immediately to the rear of said plate means exposing a portion of said background plate member interior to the outline of said indicium which portion is framed by said front face of polished brass, said portion of said background plate member having a light diffusing surface relative to said light reflective front face of polished brass and being of a colour to contrast with said light reflective front face to thereby improve visible recognition of said indicium in low light conditions.

12. A plaque as claimed in claim 11, wherein said background plate member has a black mat finish exposed within said outline.

13. A plaque as claimed in claim 12, wherein said plaque is rectangular for aligned abutment with other like plaques to provide a brass extension to collectively identify the alphabetic or numeric identification of a building or structure having an identification of a plurality of numeric or alphabetic indicium.

14. A plaque as claimed in claim 12, wherein said background plate is adhesively secured to said metal plate means, said metal plate means and said background plate having aligned holes for receiving screws to secure said plaque to a building or other structure.

* * * * *